US011054214B2

(12) United States Patent
Pellegrini

(10) Patent No.: US 11,054,214 B2
(45) Date of Patent: Jul. 6, 2021

(54) HANDGUN HOLSTER WITH A CATCH MEANS IN THE TRIGGER GUARD AREA

(71) Applicant: RADAR LEATHER DIVISION S.R.L., Fucecchio (IT)

(72) Inventor: Paolo Pellegrini, Fucecchio (IT)

(73) Assignee: RADAR LEATHER DIVISION S.R.L., Fucecchio (IT)

( * ) Notice: Subject to any disclaimer, the term of this patent is extended or adjusted under 35 U.S.C. 154(b) by 536 days.

(21) Appl. No.: 16/071,342

(22) PCT Filed: Feb. 3, 2017

(86) PCT No.: PCT/IB2017/050589
§ 371 (c)(1),
(2) Date: Jul. 19, 2018

(87) PCT Pub. No.: WO2017/134613
PCT Pub. Date: Aug. 10, 2017

(65) Prior Publication Data

US 2021/0164755 A1 Jun. 3, 2021

(30) Foreign Application Priority Data

Feb. 4, 2016 (IT) ..... 102016000011759

(51) Int. Cl.
*F41C 33/02* (2006.01)

(52) U.S. Cl.
CPC ..... *F41C 33/0236* (2013.01); *F41C 33/0263* (2013.01)

(58) Field of Classification Search
CPC ..... F41C 33/0263; F41C 33/0236
USPC ..... 224/244
See application file for complete search history.

(56) References Cited

U.S. PATENT DOCUMENTS

| | | | | |
|---|---|---|---|---|
| 3,718,240 | A * | 2/1973 | Rose | F41C 33/0209 224/243 |
| 5,284,281 | A | 2/1994 | Nichols | |
| 8,851,344 | B2 * | 10/2014 | Baumann | F41C 33/0263 224/244 |
| 2010/0176165 | A1 | 7/2010 | Lowe et al. | |
| 2013/0306691 | A1 | 11/2013 | Baumann et al. | |
| 2015/0345898 | A1 * | 12/2015 | Bardy | F41C 33/0236 224/244 |

OTHER PUBLICATIONS

International Search Report and Written Opinion for Corresponding International Application No. PCT/IB2017/050589 (11 Pages)(dated Apr. 7, 2017).

* cited by examiner

*Primary Examiner* — Scott T McNurlen
(74) *Attorney, Agent, or Firm* — Lucas & Mercanti, LLP

(57) ABSTRACT

The present invention refers in general to the field of firearms accessories. More specifically, the object of the invention is a handgun holster provided with a new firearm catching system.

8 Claims, 8 Drawing Sheets

HANDGUN HOLSTER WITH A CATCH MEANS IN THE TRIGGER GUARD AREA

CROSS-REFERENCE TO RELATED APPLICATIONS

This application is a 371 of PCT/IB2017/050589, filed Feb. 3, 2017, which claims the benefit of Italian Patent Application No. 102016000011759, filed Feb. 4, 2016.

FIELD OF THE INVENTION

The present invention refers in general to the field of firearms accessories. More precisely, the object of the invention is a handgun holster provided with a new catch system in the trigger guard area.

BACKGROUND OF THE INVENTION

A problem considered by the present applicant concerns systems for making the positioning of the handgun firm in the holster, possibly in holsters configured for housing handguns equipped with a removable aiming/lighting device, (and therefore with suitably enlarged handgun housing seat) but in fact intended to house the firearm even without the device. Such a problem concerns in particular, but not exclusively, the shaking movement of the firearm in its seat, and notably the shaking in the height direction of the firearm, i.e. the direction that completes a coordinate system with the longitudinal direction (corresponding to the axial extension of the barrel of the firearm) and the thickness direction (side-side crosswise direction of the shell-shaped body of the holster). Concerning this, it is known that even simple oscillations or slight movements may bring about dangerous situations, being the potential cause of accidental firing and/or the loss of the handgun and/or the removal thereof by third parties or even producing noises capable of revealing the position of the officer during police operations, with serious consequences to the safety of the officer in question.

SUMMARY OF THE INVENTION

Indeed, starting from such a problem, and considering the complex design requirements linked amongst other things to safety (nevertheless to match with simplicity of use), to rationality of construction, to the need to not wear out the firearm, the applicant has devised a catching system having the widest range of possible uses (therefore not limited to handgun holsters with aiming device) and indeed capable of combining in a surprisingly effective manner the satisfaction of the aforementioned requirements, together with other auxiliary ones that are nonetheless significant. This result is achieved with the holster according to the present invention, the essential characteristics of which are defined by the first of the attached claims. Further important characteristics are also given in the dependent claims.

BRIEF DESCRIPTION OF THE DRAWINGS

The characteristics and advantages of the handgun holster with catch means in the trigger guard area according to the present invention will become apparent from the following description of embodiments thereof given as an example and not for limiting purposes with reference to the attached drawings, in which.

DETAILED DESCRIPTION OF THE INVENTION

Figure 2:
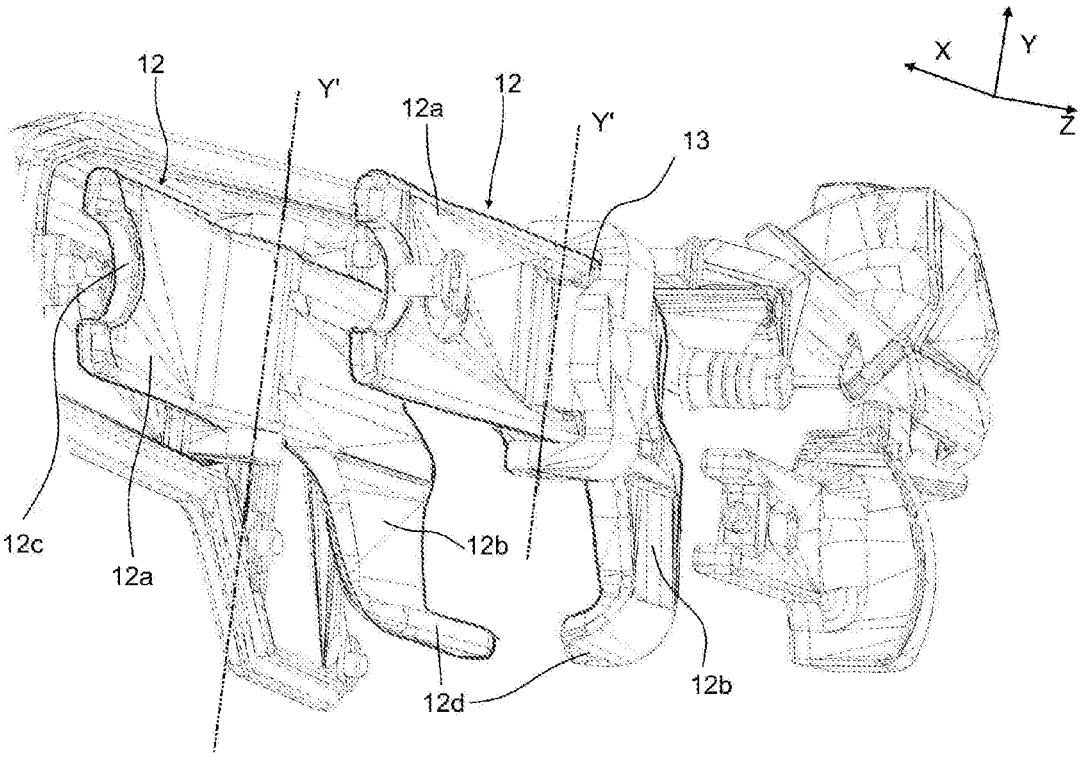
FIG. 2 is an axonometric view of an exploded representation of the holster of FIG. 1, without the handgun and with certain parts omitted, among which the main shell-shaped body of the holster, for the sake of clarity of illustration.
Figure 1:
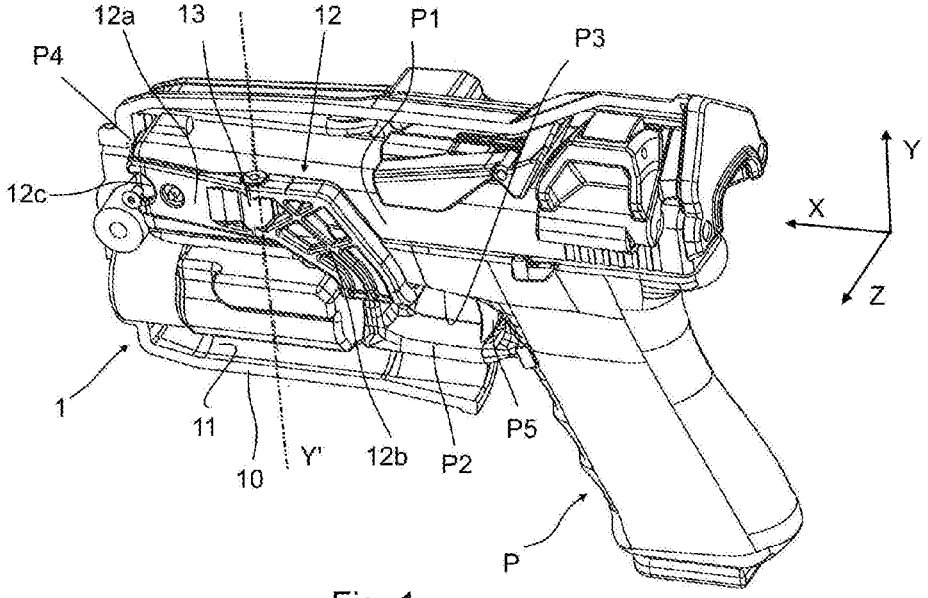
FIG. 1 is an axonometric view of a longitudinally broken representation of a holster according to the invention, with a handgun inserted, in a first embodiment.
Figure 3:
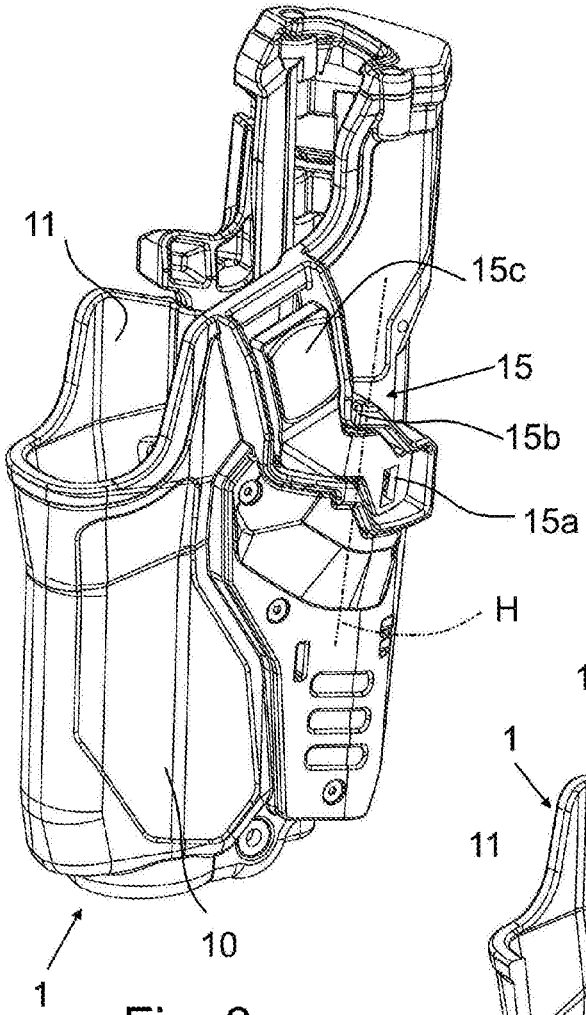
FIG. 3 is an axonometric view of a holster with a catching system analogous to that of the previous figures but that here shows a lock system provided for in a second embodiment of the invention.
Figure 4:
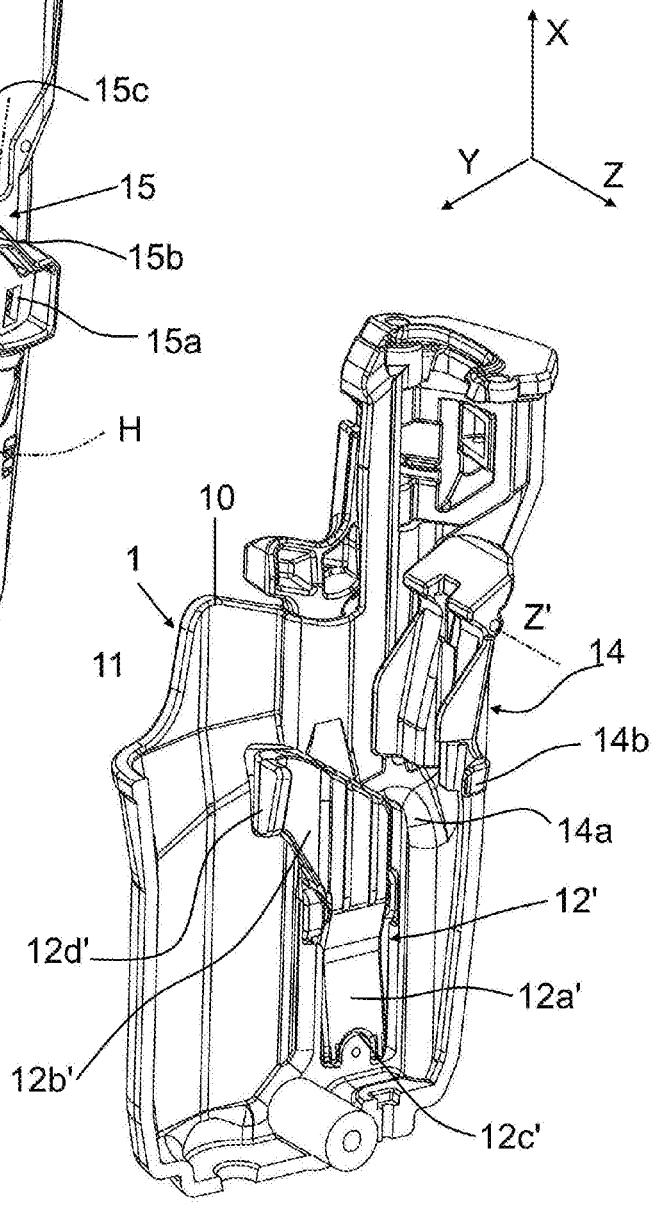
FIG. 4 is an axonometric view of a longitudinally broken representation of the holster of FIG. 3.
Figure 6:
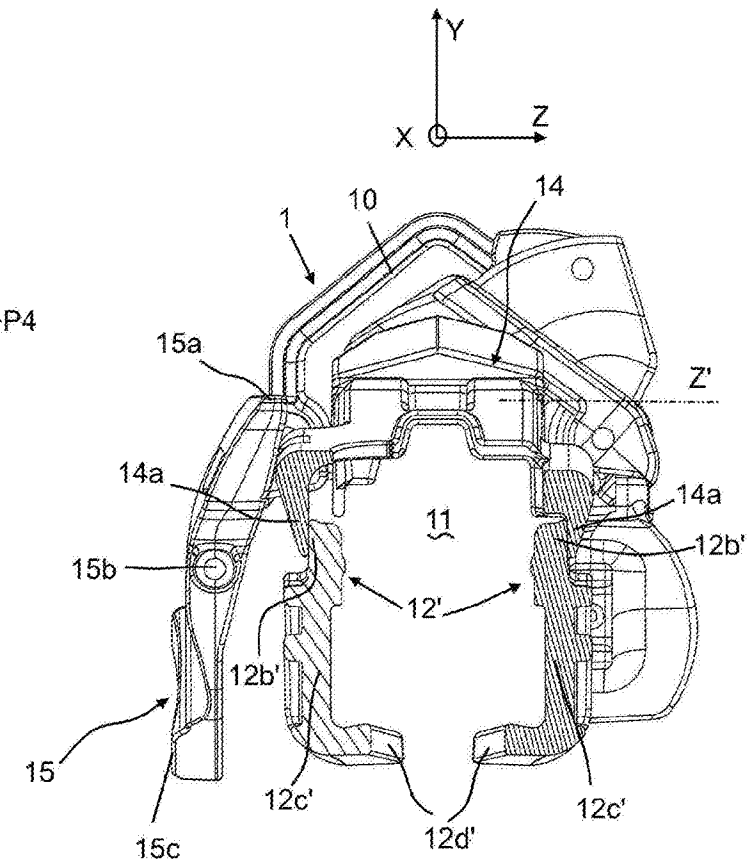
FIG. 6 is a sectional view taken along the plane indicated by the arrows VI-VI of FIG. 5.
Figure 5:
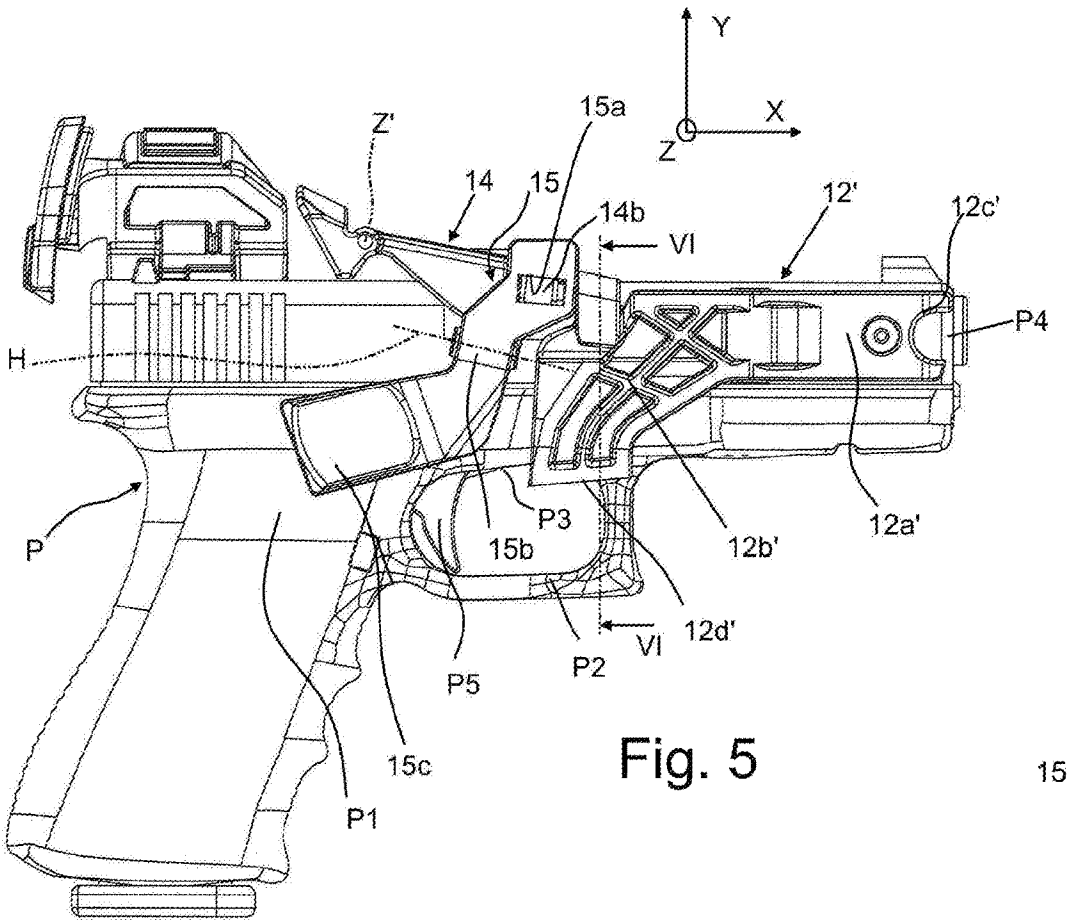
FIG. 5 is a side view of an exploded representation of a holster conceptually analogous to those of FIGS. 3 and 4, the representation of which omits certain parts, among which the main shell-shaped body, showing the functional core of the holster in its interaction with a handgun, also shown in the figure.
Figure 7:
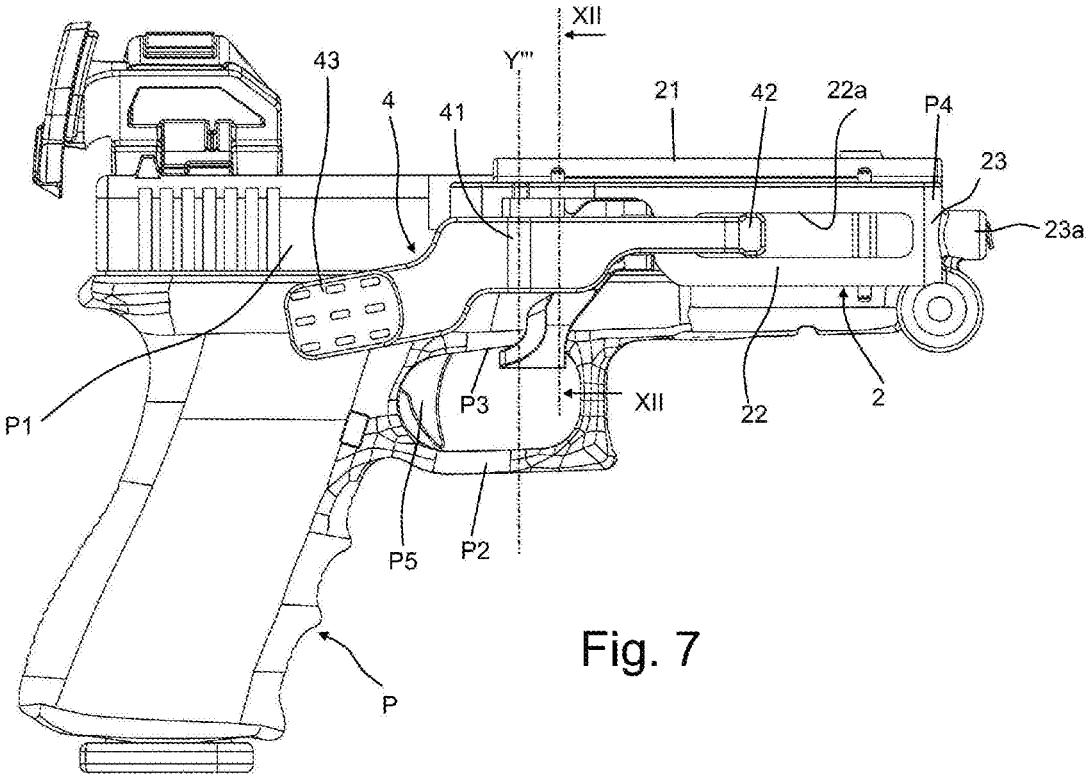
FIG. 7 is a side view representation analogous to that of FIG. 5, but of a solution according to a third embodiment of the holster according to the invention.
Figure 8:
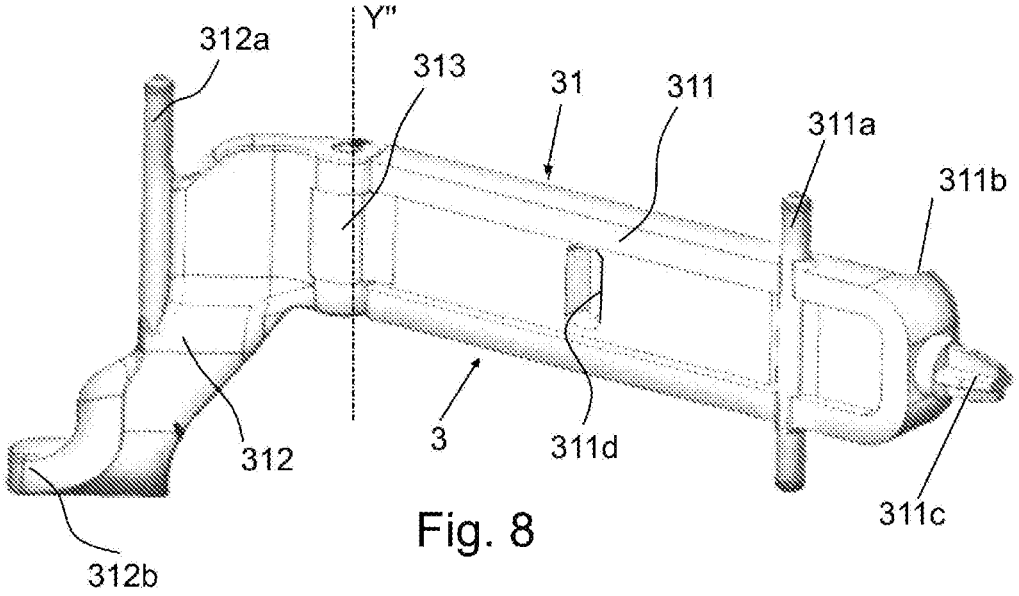
FIG. 8 and FIG. 9 are axonometric views, respectively, of a handgun catch device and of the same device mounted on a support guide sliding in the holster according to the third embodiment, represented in isolation, the assembly of FIG. 9 being represented as a view from a lower side.
Figure 9:
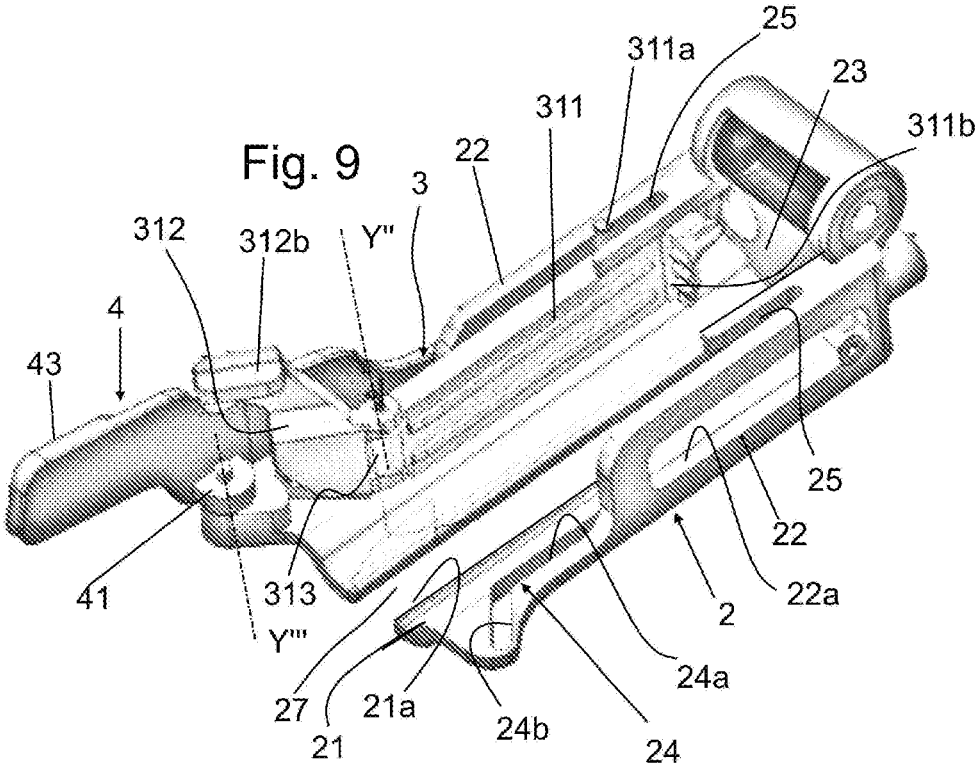

Considering, for the moment, FIGS. 1 and 2, a handgun P is represented along with a holster 1, the latter—shown only partially—being adapted to house the handgun P. Taking the gun as a reference, three mutually perpendicular directions can be identified to define a coordinate system; X is the longitudinal direction, according to which the axis of the firearm barrel P extends; Y is the height direction (as seen in a normal firing configuration with the barrel substantially horizontal, i.e. parallel to the ground from which the user stands up), according to which the butt or handgrip of the handgun, and the trigger, substantially project with their length; Z, on the other hand, is the thickness or crosswise direction, perpendicular to the first two, i.e. perpendicular to the side walls of the handgun P.

The holster 1 comprises a shell 10 in which a cavity 11 opens up for housing the firearm. The cavity 11 extends along the direction X between the insertion opening and a bottom. Every other characteristic and component not expressly described is in accordance with the prior art. The cavity, in this embodiment, is of a shape and size such as to house the handgun P in a tight-fitting and firm manner substantially according to all of the directions when it is associated with a light device system (or aiming system) L. It should also be mentioned that the handgun P conventionally has, as well as a stock P1, a muzzle portion P4 (tip portion on which the barrel opens with the outlet hole), a trigger P5 protected by a guard P2, and an inner face P3 of the stock P1 facing the inside of the guard and from which the trigger itself projects.

Now coming more specifically to the aspects of the invention, the holster 1 is associated with reversible holding and catch means of the handgun P that operate inside the cavity 11 by pressing the gun or in any case in engagement with it so as to prevent accidental movements. According to the invention, conceptually, such catch means make contact with the firearm, for example and preferably but not necessarily, at the aforementioned inner face P3 of the trigger guard and are mechanically driven by the gun itself, more precisely by the muzzle portion P4, when the firearm is fully inserted in the cavity.

In the first embodiment, indeed shown in FIGS. 1 and 2, the catch means comprise at least one lever, but preferably two levers 12 hinged to the side walls of the shell 10 around respective axes Y' for example (but not necessarily) substantially parallel to the height direction Y. The hinging point is in the form of respective hinges 13 positioned in an intermediate region (following the direction X) of the elongation of the barrel, the pivotal axis being suitably spaced from the inner face of the relative side wall of the shell, so as to allow the rotation of the levers, and central with respect to the development of the lever; on each lever the hinges thus define a front arm 12*a* that projects in the direction X towards the bottom tip of the holster, and a rear arm 12*b* that extends towards the butt area, with at least in part a diagonal orientation, i.e. with a component along the direction Y so as to reach close to the guard of the handgun when the same is inserted.

Obviously, in this regard, the bulk of the levers in relation to the configuration of the cavity will be such as to allow the housing of the firearm, with the remarks that will be made hereinafter. The front arm 12*a* ends with a free first end 12*c* of the lever, close to the bottom end of the cavity 11 whereas the rear arm ends with a free second end of the lever that is configured with a catch wing 12*d*, bent towards the inside of the cavity, and therefore over the plane XZ so as to make contact, in this case, with the inner face P3 of the trigger guard, determining a stop/catching action in the height direction Y. Each lever is thus pivotable around its own axis Y' starting from a release position, in which the front arm 12*a* is spaced from the side wall of the shell towards the inside of the cavity (with the first ends 12*c* mutually converging and adapted for mechanically interfering with the handgun in a final segment of the insertion stroke), and the rear arm with the wing 12*d* at the second end, instead, is close to the side wall of the shell (the two second ends are thus opened apart and divergent in the direction of the thickness Z). The other stop position of the rotation of the levers is a catch position, in which an opposite arrangement occurs (front arms opened out, rear arms spaced from the shell and brought mutually closer). Elastic means such as a spring (not shown) tend to keep the levers in the release position in the absence of actuation, and thus in particular in an empty holster condition.

When the handgun is inserted in the cavity, fully penetrating into it, a situation is reached in which the levers 12, up to that moment in the release position (or, in other words, rest position), are actuated by the thrust of the muzzle portion P4 on the first ends 12*c*, said thrust in practice taking place in this case with a lateral/transversal component (direction Z) and being actually exerted by the sides of the slide portion of the gun, indeed in the proximity of the muzzle. The thrust causes the rotation of the levers that with the second ends clutch onto the firearm overcoming the resistance of the springs. The wings 12*d* embrace the inner face of the trigger guard and by contacting it exert a firm counteraction to shaking, even and particularly in the height direction Y. Such a latching action is achieved whether or not the handgun is equipped with the aiming device (when the device is mounted, nothing prevents its accommodation in the relative housing region, because until the firearm is close to the insertion end stop the wings remain opened out, not interfering with the device), so that the catch means determine a complete and effective improvement as far as safety is concerned.

According to this first embodiment, the catch means as such do not oppose the removal of the firearm, so that the holster will provide for other independent and conventional systems for locking undesired extractions. Accordingly, when going to remove the firearm, as the motion starts, the lateral thrust exerted by the muzzle ceases, and this allows the free rotation of the levers (the first ends coming mutually close to the inside) urged by the springs and with consequent opening out of the wings, clearing the passage necessary to extract the handgun.

With reference now to FIGS. 3 to 6, a second embodiment of the invention provides for a lever or two catch levers analogous to those just described, and therefore not described again (the reference numerals are used in conformity with the previous embodiment, with the sole addition of a superscript ', and make the drawings self-explanatory). An additional equipment, however, consists of lock means for locking the catch means when they are in the catching position, whereby the extraction of the handgun requires the unlocking of an additional safety, i.e. the prior actuation of the (un)lock means.

The lock means can advantageously comprise a pivoting member 14 mounted within the cavity 11, more precisely in the back of the shell (rib corresponding to the ridge or upper side of the slide/handgun), in a rotatable manner about an axis Z' parallel to the direction Z. The pivoting member 14, shaped and positioned so as to allow the passage of the firearm, has one (like in the variant of FIGS. 3 and 4) or two (like in the variant of FIGS. 5 and 6) projections 14*a* adapted to become inserted in mechanical hindrance between a relative side wall of the shell and the outer face of the rear arm 12*b*' of the relative lever 12', therefore in the proximity of the second end with the wing 12*d*'. By means of such an insertion (in a locking position of the pivoting member), and the mechanical hindrance or abutment that derives from it, the levers are prevented from opening out at the rear part, as would be required to shift from the catch position to the release (or rest) position. In this way, the handgun cannot be extracted unless the pivoting member has been pre-emptively rotated towards an unlocking position that lifts the pivoting member itself, tilting it closer to the inner face of the back rib of the shell. The unlocking motion occurs by overcoming the opposing force of elastic means, also in this case not shown, which tend to keep the pivoting member in the locking position.

The motion of the pivoting member can be driven by a user, with an appropriate transmission system that permits an actuation through a finger of the hand intended to grip the firearm. The prior art suggests various substantially equivalent ways to attain a transmission of this type, though in different contexts. One of them, as an example, is the one represented in the figures where the pivoting member 14 has a tooth 14*b* projecting obliquely at the outside of the shell to engage with a slot 15*a* at a first end of a rotary lock lever 15. Such a lever is hinged centrally on the outside of a side wall of the shell, with a central hinge 15*b* having a rotation axis H lying on the plane XY and typically having a certain angle with respect both to the direction X and to the direction Y. At the second end the lever 15, substantially S-shaped to make actuation easier, has a recess 15*c* to promote pressing with the index finger of the hand close to the shell.

Such pressure, again counteracted by a spring (not shown), has the effect of lifting the first end that through the slot 15*a* pulls the tooth 14*b* of the pivoting member, in turn lifting it and thus clearing the locking effect that blocks the rear arms of the catch levers from opening out. As mentioned, the transmission of the drive to the pivoting member and consequent motion thereof can exploit systems different from rotation, for example with a button to be activated by sliding along the direction X and/or intended to interact with fingers other than the index finger.

A solution with analogous safety characteristics is the one illustrated in the remaining FIGS. 7 to 12*b*, which will be referred to hereinafter. In this case, however, with respect to the previous examples, the embodiment is shown as applied to a normal holster (i.e. not intended to house handguns with aiming device), and the solution differs in the type of catch means with respect to rotary levers.

In fact, the catch means provide for a guide system that is substantially of a slidable type, and comprises e.g. a guide 2 irreversibly inserted in the holster cavity region intended for housing the front part of the handgun. The guide 2 (see FIG. 9 in particular) comprises an elongated ridge wall 21 resulting on the ridge side of the handgun from which two flanks 22 project on longitudinally opposite sides, running parallel to the direction X; from a front side of the wall, perpendicular to the longitudinal direction X, a front wall 23 projects in proximity with the bottom of the shell. Between the flanks and the front wall an insertion track 27 for the front part of the handgun is defined, with a central opening 21*a* on the ridge wall 21 allowing for the sliding accommodation of the gunsight. In the proximity of the flanks 22, two slits 24 are formed in the ridge wall 21, running along the aforementioned two longitudinal sides. The slits 24 comprise each a prolonged straight front segment 24*a* that runs from the front wall 23, parallel again with the direction X, and a shorter rear slanting segment 24*b* that diverges outwards from such a direction by a certain angle, for example about 45°.

This catch arrangement, actually a more structured device in this case, are completed by the actual catch means 3, specifically in the form of articulated sliders 31 (two in this example, although in FIG. 9 one is not shown for the sake of clarity of illustration), sliding in the guide slits 24 and each formed from two members, mutually articulated around an axis Y" parallel to the height direction. The two members consist of a front arm 311 and of a rear catch 312 mutually articulated through a joint 313. The sliding engagement with the slits 24 is carried out for example by means of pegs 311*a*, 312*a* that project in the direction Y in insertion within the tracks; for a greater stability each peg 311*a* of the arm 311 can also project from both the opposite sides of the arm, in order to engage, besides with the slit 24, with an additional guide channel 25 that the guide 2 provides along the edge of the flanks 22 spaced apart from the ridge 21. Each rear catch 312 has a catch wing 312*b*, bent inwards and typically on the plane XZ so as to come into contact, also in this case, with the inner face P3 of the trigger guard analogously to the wings of the previous embodiments.

The movement of each slider 31 occurs from a rearward, release position (see FIGS. 9 and 12*a*) in which the catch 312 is arranged in the slanting rear segment 24*b* of the slit 24, and therefore is slanting and opened out with respect to the central longitudinal axis of the guide 2, clearing the central track 27 from any interference with the firearm. A catch position is, on the other hand, determined by the forward movement of the slider towards the front wall 23 along the slits 24, said forward movement making the catch 312 enter into the straight front segment 24*a* of the slit, with consequent rotation around the articulation 313 and positioning of the wing 312*b* to interfere with the lane to exert the stop, once again on the face P3 inside the trigger guard (see FIG. 10 that highlights the nature of the motion through the thick arrows, and FIG. 12*b*).

Figure 10:
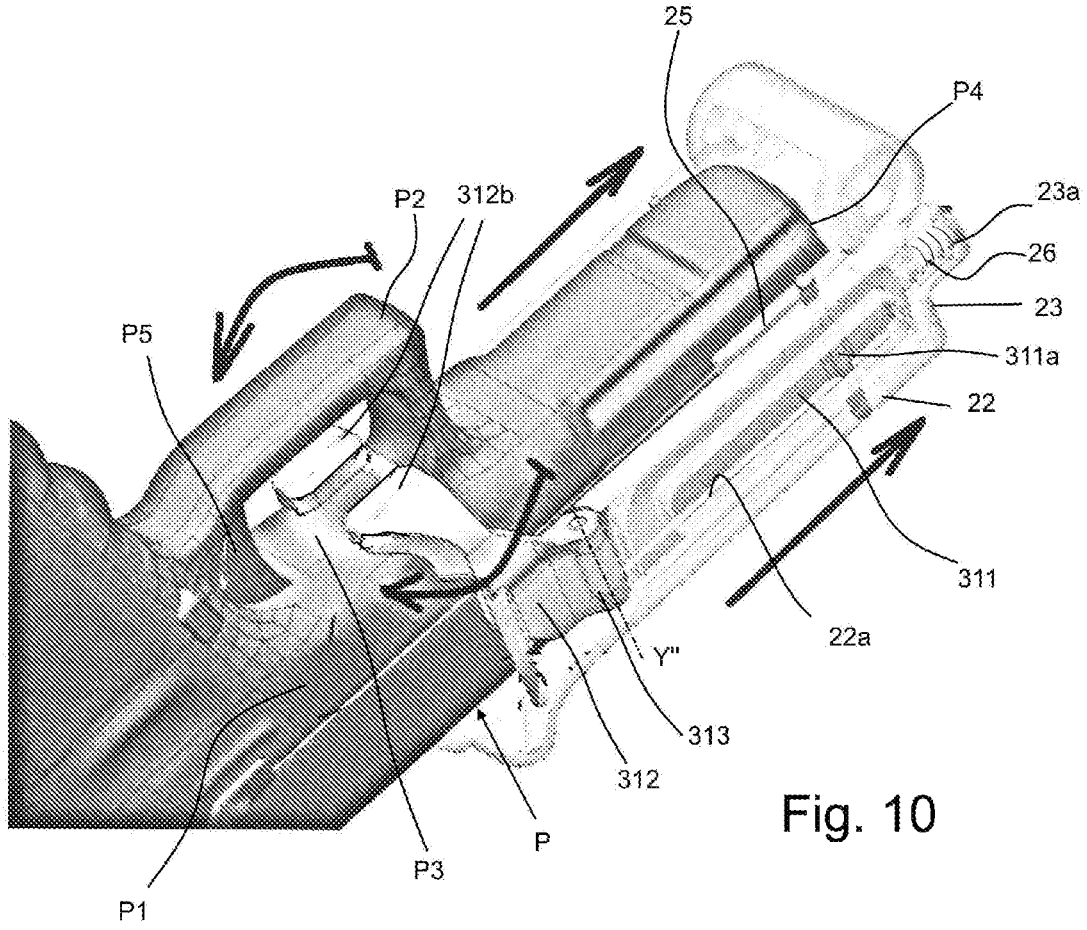
FIG. 10 is an axonometric view of an assembly comprising the guide (represented in phantom lines) and two catch devices according to the two previous figures, represented together with a handgun in a catching configuration thereof, the remaining parts of the holster, including the main shell-shaped body being, omitted for the sake of clarity of illustration.

FIG. 10 indeed also clarifies how the movement towards the catch position is actuated by the same handgun that with its muzzle presses on steps 311*b* that the arms 311 form in the proximity of the front end. Such a movement towards the catch position is preferably elastically opposed by a spring 26 compressed each between a tip 311*c* of the arm 311 and the front wall 23; more precisely in this example the springs 4 are housed by cylindrical seats 23*a* provided by the wall 23.

Figure 11:
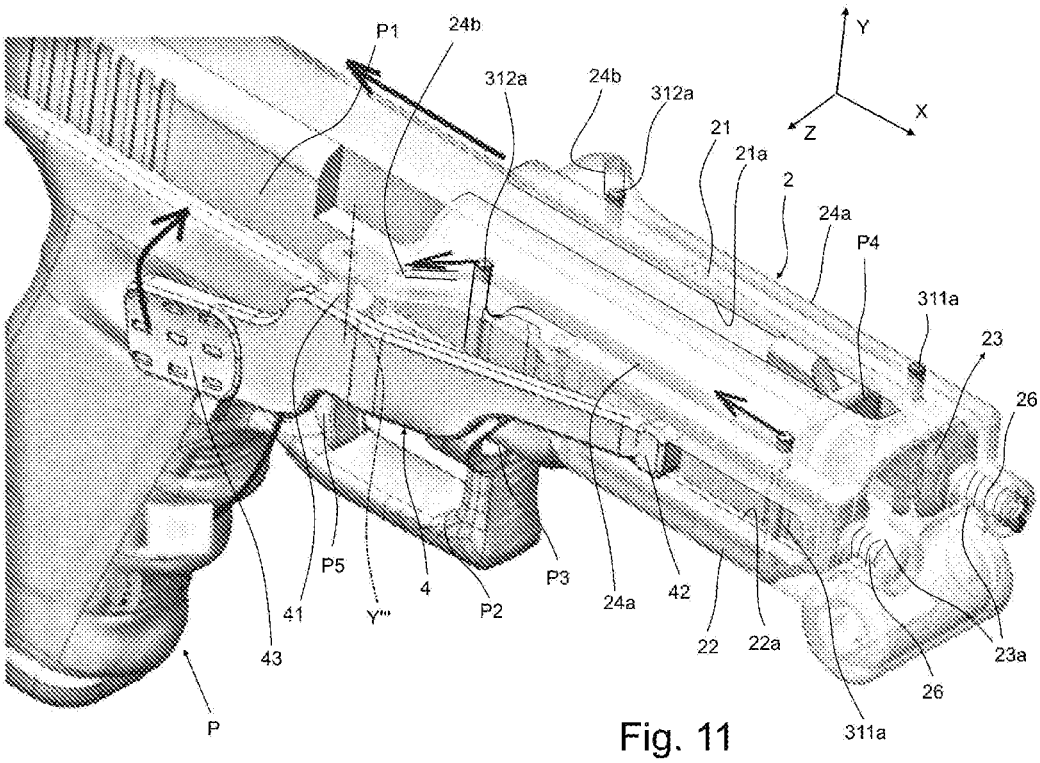
FIG. 11 is another axonometric view, from a different angle, of the assembly of FIG. 10, with the guide represented in phantom lines, along with the handgun, a locking/unlocking lever being in this case also shown.
Figure 12B:
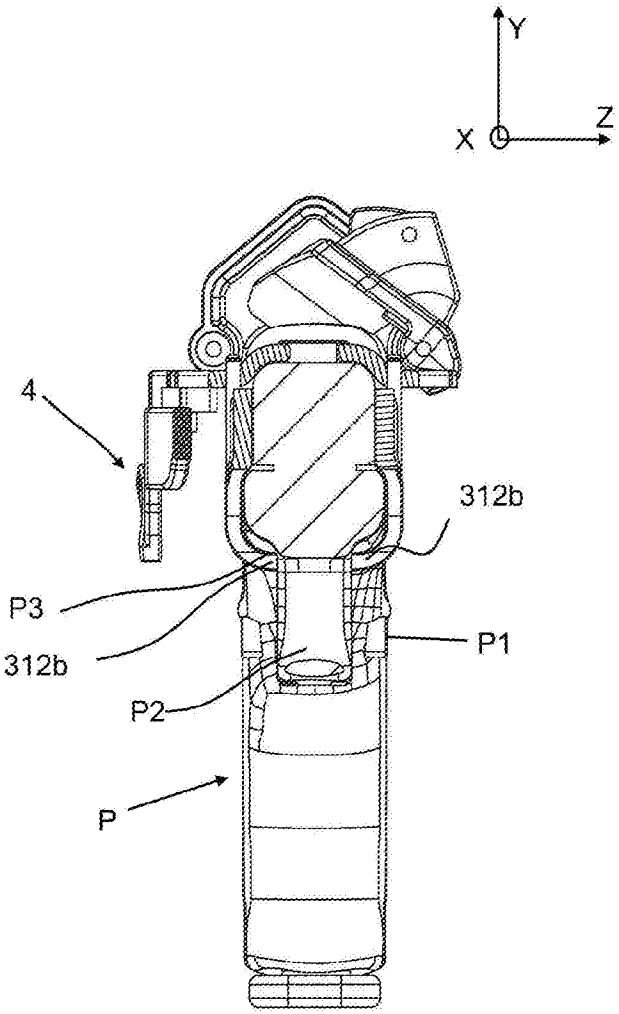
FIGS. 12*a* and 12*b* are sectional views of the handgun and parts of the holster taken along the plane indicated by the arrows XII of FIG. 7, certain parts of the holster being therefore analogously omitted, among which the main shell-shaped body, the two figures respectively referring to an unlocking/release configuration of the handgun and to a locking/catching configuration thereof.
Figure 12A:
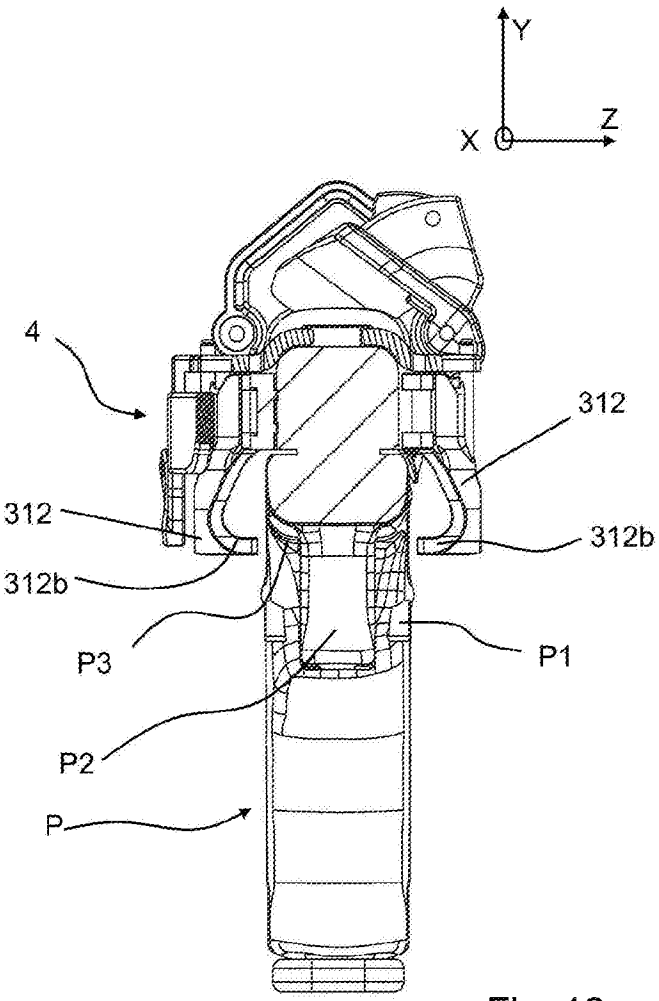

The catch device according to this embodiment is completed by a lock/unlock lever 4 (see in particular FIGS. 7, 9, 11) that is used to secure the catch position and, when activated to unlock, to allow the return of the slider or sliders 31 towards the release position by effect of the thrust of the springs 26 (FIG. 11, also exhibiting thick arrows that help understanding the movement).

The lock lever 4 of this example therefore comprises: a central pivot 41 through which the lever is made rotatably supported by the ridge wall 21 of the guide 2, the rotation occurring around an articulation axis Y" again parallel to the height direction Y; a first end with a tooth 42 adapted for snap-engagement (passing through a window 22*a* of the relative flank 22) with a seat 311*d* (FIG. 8) formed at a suitable position in the arm 311; and a second end with an ergonomic shape 43 for the actuation by pressing with a finger of the user's hand, specifically the index finger again. A spring, not shown, urges the automatic positioning of the lever 4 in rotation towards the lock position, in the absence of external actuation.

The operation of this embodiment is therefore clearly in accordance with the same functional pattern as the previous embodiments (lock in the trigger guard area actuated by insertion of the handgun through mechanical action by the relative muzzle portion), with a constructive arrangement that can be advantageous in certain circumstances. In particular, the sliding with subsequent rotation/opening at 45° of the catches 312 allows a greater clearance of the catch wings 312*b*, actually permitting the insertion into the holster of handguns equipped with particularly bulky aiming/illumination systems. Moreover, the catching system of the handgun in the holster can advantageously be entirely housed on a guide 2 making an assembly that is autonomously functional and that can thus be inserted inside pre-existing normal holsters. not necessarily rigid, given that all the elements of the device are operatively autonomous in the assembly itself. In a possible variant, without elastic means such as the springs 26, it can be the same extraction of the handgun that mechanically urges the rearward movement towards the release position.

Generally speaking, all of the embodiments described above provide some important advantages of the invention. The stop/catch action in the guard area, and in particular according to a preferred solution on the inner face P3, ensures a firm and secure catching of the firearm, in particular with respect to shaking in the direction Y, the catching being activated with safety and simplicity by the same insertion of the handgun, automatically. The catching action, also and in particular depending on the specific configuration of the handgun, can also occur, with equivalent solutions to those mentioned above, on different points of the firearm, for example on the same guard or parts of the stock adjacent or close to it, with catching action having directional components correspondingly adapted.

Whether the catch means act in rotation, or by siding, the solution is constructively basic and productively cost-effective, ensuring reliable operation over time. The operation is fluid, does not require effort from the user and is remarkably unaffected by the protracted use, also considering that it does not include parts that are subject to significand bending or in any case deformations. The catch means even carry out, before the catching, a guiding and slightly pulling action during the insertion of the handgun that facilitates the correct positioning thereof.

The interaction with the handgun is such as not to create rubbing, so that there are no significant wearing phenomena, also of the firearm itself which for the same reason is substantially exempt from scratches or small abrasions, that possibly and only in the worst case can involve only the face of the stock inside the trigger guard, and thus an area not exposed to view. Furthermore, in case of use for a handgun with an aiming device, the system is not such as to involve risks of having such device held and trapped inside the holster when the firearm is extracted, given that the device does not even come into contact with the catch means. The variants with the accessory lock means add a safety provision that can basically determine an integrated stop and lock system of the handgun usable in any type of holster.

If required in order to increase stability and counteract the movement of the handgun, especially in the direction Y, the holster can be equipped with a pin projecting from the bottom of the cavity to engage with the hole of the barrel, creating a second holding point of the firearm. Other criteria that can make one embodiment more or less preferable with respect to the other include evaluations of simple productive or economic nature, with it being understood that all of the described solutions are functional and structurally simple and therefore competitive both in terms of manufacturing costs and reliability and ease of use. The example solutions illustrated are moreover subject to various constructive adaptations that in any case do not alter the structural and operative concepts.

In order to manufacture the catch means it is possible to use a wide range of materials, with reference of course to the specific field of application, like for example the self-lubricating polymers (acetyl resin POM) or nylon PA also doped with glass fibres, or harmonic steel or die-cast metal.

The present invention has been described up to here with reference to preferred embodiments thereof. It should be understood that there can be other embodiments that derive from the same inventive core, as encompassed by the scope of protection of the claims given below.

The invention claimed is:

1. A handgun holster comprising:

a shell defining an inner cavity with a bottom, for housing a handgun provided with a trigger guard, the cavity extending along a longitudinal direction starting from a gun insertion end, the holster further defining a handgun height direction and a crosswise width direction orthogonal with a plane defined by said longitudinal direction and said height direction, and handgun catch means housed in said cavity, movably supported by said shell, said catch means being movable between a handgun release position and a handgun catch position, in which they respectively permit the insertion/extraction of the gun and are configured to exert a catching action on the same gun, said catch means comprising a first end in proximity with said bottom, configured to come into contact with a muzzle portion of the gun when the same is pushed deep into the cavity, a second end arranged in the trigger guard area and provided with at least one catch member configured to exert a catching action on the gun at a guard portion, said catch means being arranged such that the contact of said muzzle portion and said first end in an inserted positon in proximity with the bottom of the cavity drives the catch means from said release position to said catch position and conversely as the handgun is extracted from the cavity the release position is attained;

wherein said catch means comprise at least one catch lever pivotally supported by said shell around an axis and comprising said first and second ends, said first end being slanting inwards in said cavity in said release position and thus configured to mechanically interfere with the gun in a final segment of its insertion run, being driven by said muzzle portion with a thrust having a component in said crosswise direction, the holster further comprising elastic means adapted to urge the catch means towards said release position and to keep them stably in such position when the holster is empty, whereby the thrust causes the rotation of the at least one lever to the catching position in which the second end clutches on the handgun overcoming the hindrance of said elastic means.

2. The holster according to claim 1, further comprising lock means of the catch means when the same are in the catching position, adapted to be actuated by a user towards an unlock position in which said catch means are unrestrained from taking said release position.

3. The holster according to claim 1, wherein said catch member of said second end comprises at least one catch wing adapted to exert an abutment action on the handgun with a component restraining the handgun in said height direction.

4. The holster according to claim 1, wherein said axis of said lever is substantially parallel with said height direction.

5. The holster according to claim 4, comprising lock means of the catch means when the same are in the catching position, comprising a pivoting member turning around an axis parallel with said crosswise direction and comprising at least one protrusion adapted to abut, in a locking position, on an outer face of said catch lever in proximity with said second end, with a component parallel with the same crosswise direction, to prevent movement of the lever towards the release position.

6. The holster according to claim 5, wherein said lock means further comprise actuation means adapted to transmit the actuation of a user to said pivoting member from the locking position to the unlocking position.

7. The holster according to claim 1, wherein said catch means are adapted to exert the catching action at an inner face of the guard or at a handgun part facing the inside of the same guard.

8. The holster according to claim 1, comprising a pair of catch means arranged in a mutually symmetrical fashion on opposite side walls of said shell.

* * * * *